United States Patent [19]

Greene

[11] Patent Number: 4,831,997

[45] Date of Patent: May 23, 1989

[54] WRIST STRAP

[76] Inventor: James H. Greene, Rt. 1 Box 895, North Wilkesboro, N.C. 28659

[21] Appl. No.: 132,920

[22] Filed: Dec. 15, 1987

[51] Int. Cl.[4] ..... F41D 11/02

[52] U.S. Cl. ..... 124/35 A; 24/306; 2/170

[58] Field of Search ..... 124/35 A, 19, 31, 41 R, 124/35 R; 2/170, 162, 159, 19, 17, 20, 161 A; D2/610; D29/20; 272/67, 68, 143; 434/248, 249; 223/78; D22/107; 24/306; 128/77, 87 R, 87 A, 165, DIG. 15; 441/69, 75; 114/39.2

[56] References Cited

U.S. PATENT DOCUMENTS

| | | | |
|---|---|---|---|
| 1,200,580 | 11/1916 | Brenner | D29/20 |
| 3,423,095 | 1/1969 | Cox | 2/162 |
| 3,535,718 | 11/1970 | Murcott | 128/DIG. 15 |
| 4,426,989 | 1/1984 | Sutton | 124/35 A |

OTHER PUBLICATIONS

Tru-Fire Advertisement
Fletchunter and Barner Releases Advertisment
The Trophy Hunter Bow Release Advertisement

*Primary Examiner*—Randolph A. Reese
*Assistant Examiner*—Carol I. Bordas
*Attorney, Agent, or Firm*—Steven J. Hultquist

[57] ABSTRACT

A wrist strap for use with a bowstring release includes a V-shaped body having an inner surface and an outer surface. A tab is secured to the body outer surface at the apex. A cavity is provided between the tab and body for removably receiving a bowstring release. A first system of fasteners is provided on the body for securing the wrist strap on a wrist. A second system of fasteners is provided on the body for tightening and securing the wrist strap on a wrist. In a preferred embodiment, the fastener systems comprise hook and loop fasteners.

18 Claims, 3 Drawing Sheets

WRIST STRAP

BACKGROUND OF THE INVENTION

1. Field of the Invention

The present invention relates generally to a wrist strap, and in particular, is concerned with an archery wrist strap for use with a bowstring release.

2. Description of the Related Art

Bowstring releases are hand-held devices used by archers to draw and smoothly release a bowstring, thereby enhancing the accuracy of an arrow's flight. Generally, a bowstring release includes a means for releasably securing a bowstring and a trigger. First, the bowstring is received in the securing means. Next, the bowstring is drawn with the bowstring release as the archer aims an arrow. At the appropriate moment, the trigger is actuated to release the bowstring from the securing means. The bowstring release permits a smooth, frictionless release of the bowstring. Representative examples of bowstring releases are found in U.S. Pat. Nos. 4,403,594 and 4,485,798.

Oftentimes, a wrist strap is used in conjunction with a bowstring release. A threaded rod, tie cord or other means is utilized for fastening a bowstring release to a wrist strap. The wrist strap carries the bowstring release, thereby eliminating the need to carry the bowstring release in an archer's hand. Moreover, the use of a wrist strap transfers bowstring pressure from the fingertips to the wrist. With a wrist strap, an archer uses the strength of the wrist, forearm and upper arm when drawing a bowstring. Without a wrist strap, an archer must grip the bowstring release with only the fingers and hand as the bowstring is drawn. Use of a wrist strap and bowstring release generally result in better accuracy and more draw power for an archer.

Wrist straps are frequently constructed from leather or another suitable material. A conventional wrist strap incorporates a buckle arrangement or hook and loop fasteners to retain the wrist strap on the wrist.

A particular problem in a conventional wrist strap is its tendency to twist during a bowstring draw. During a draw, a wrist strap is pulled away from the palm of a user. Twisting of a wrist strap may cause discomfort to a wearer and may cause a wrist strap to slip. Moreover, a twisted wrist strap may impart undesirable movement to an arrow as it is released, thereby decreasing the accuracy of aim.

The art continues to seek improvements. An improved wrist strap should be adaptable for use with many types of bowstring releases. It is desirable that a wrist strap be easily secured to and fit comfortably on a wrist, particularly during a bowstring draw. An improved wrist strap should not twist or slip during a draw and should enhance the accuracy of aim and draw power of an archer.

SUMMARY OF THE INVENTION

The present invention includes a wrist strap for use with a bowstring release. The wrist strap can be easily mounted on a wrist and is adaptable for use with many conventional bowstring releases. The wrist strap remains adjacent to an archer's palm during a draw of a bowstring, thereby reducing torsion and twisting found in conventional straps. The present wrist strap enhances the accuracy of an aim and the smoothness of a release.

The wrist strap is comfortable to wear and inexpensive to manufacture.

In a preferred embodiment, the present invention includes a wrist strap for use with a bowstring release. The wrist strap includes a V-shaped body having an inner surface and an outer surface. A tab is secured to the body outer surface at the apex. A cavity is provided between the tab and the body for removably receiving a bowstring release. Means are provided for removably securing the wrist strap body to a wrist. In a preferred embodiment, the wrist strap securing means may comprise a first system of fasteners provided on the body for securing the wrist strap on a wrist, and a second system of fasteners provided on the body for tightening and securing the wrist strap on a wrist. In a highly preferred embodiment, the fastener systems comprise contact-fastenable fastening surfaces, e. g. hook and loop fasteners.

DETAILED DESCRIPTION OF A PREFERRED EMBODIMENT

A preferred embodiment of the present wrist strap, indicated generally at 10, is illustrated in FIGS. 1–5.

The wrist strap 10 includes a body 12. In a preferred embodiment, the body 12 is V-shaped member having a first portion 14A and a second portion 14B. However, other body 12 shapes and configurations are within the scope of the present invention. Body 12 includes an inner surface 12B which is worn against a wearer's wrist.

Figure 1:
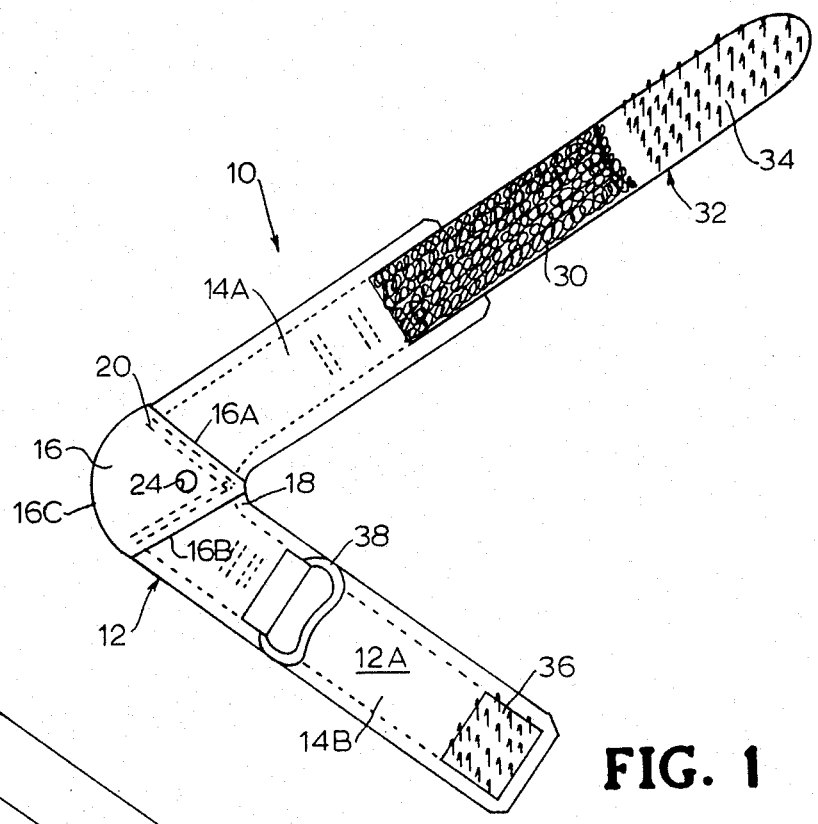
FIG. 1 is a front elevational view of a preferred embodiment of the present wrist strap.
Figure 2:
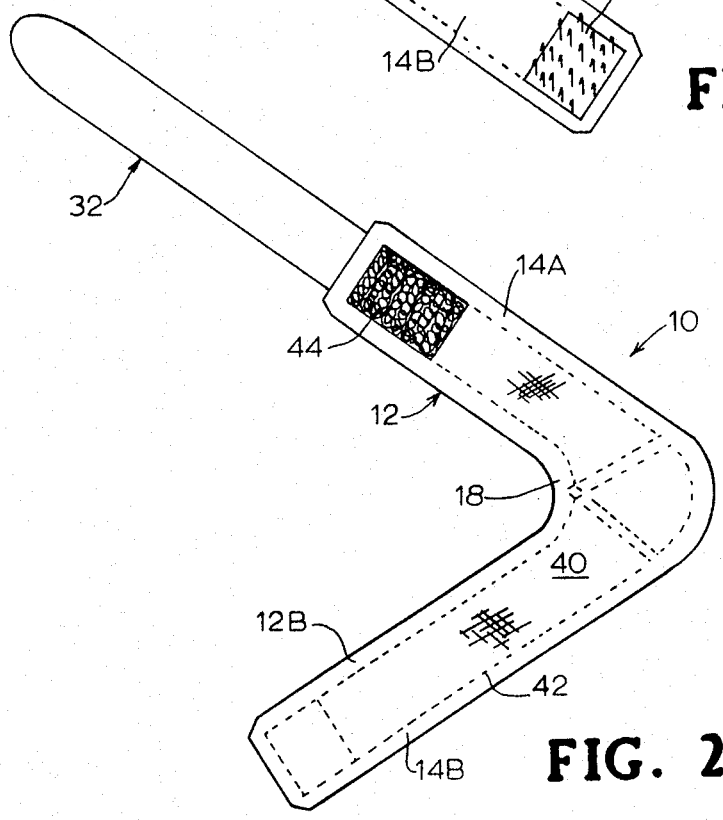
FIG. 2 is a rear elevational view of the wrist strap of FIG. 1.
Figure 3:
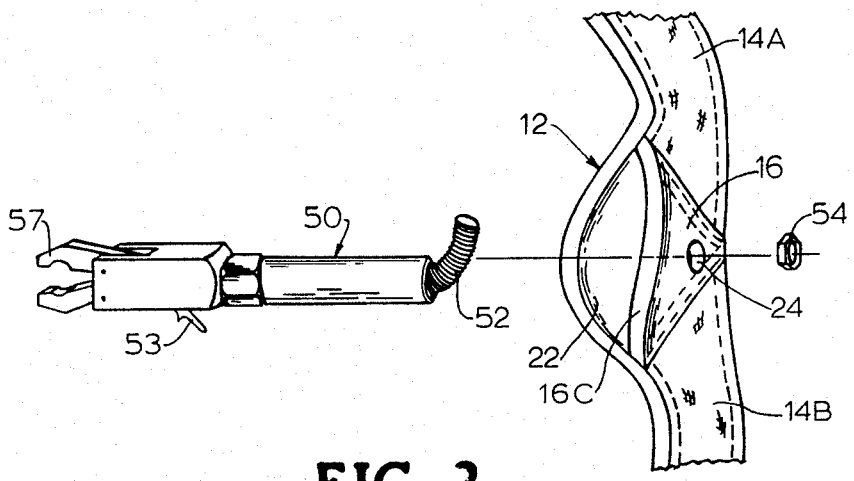
FIG. 3 is a partial, exploded perspective view of the present wrist strap in combination with a conventional bowstring release.

An outer surface 12A of the body 12 (with respect to a wearer's wrist), includes a tab 16 at the apex 18 of the body 12. Tab 16 is a substantially triangular member having side edges 16A, 16B, 16C. Tab 16 is secured to the outer surface 12A by stitching, sewing or other suitable means indicated at 20. The stitching 20 is provided along side edges 16A, 16B only. As illustrated in FIG. 3, a cavity 22, open at side edge 16C, is formed between tab 16 and body 12 by stitching 20. It is preferred that side edge 16C be complementary to the body 12. An opening 24 is provided in the central portion of tab 16.

Dual systems of contact-fastenable fastening surfaces are provided on body 12 to removably secure wrist strap 10 on a wrist. In a preferred embodiment, first system includes hook fasteners 36 provided on the outer surface 12A of second portion 14B. Loop fasteners 44 are provided on the inner surface 12B of first portion 14A. Fasteners 36, 44 are mated with each other as described below. Of course, hook and loop fasteners 36, 44 can be alternated with each other. Hook and loop fasteners 36, 44 can be formed from Velcro® fastener strips or other contact-fastenable surfaces sewn to the body. Alternately, mechanical fastening means, such as snaps, buttons, zippers or interlocking ring-type fasteners can be substituted for fasteners 36, 44.

The second system includes a strap 32 connected to outer surface 12A and extending along the longitudinal axis of the first portion 14A. Strap 32 includes loop fasteners 30 and hook fasteners 34. A ring 38 is provided on the outer surface 12A of second portion 14B between tab 16 and hook fasteners 36. Hook and loop fasteners 30, 34 are mated as strap 32 is looped through and tightened about ring 38. Of course, hook and loop fasteners 30, 34 can be alternated with each other. Alternatively, loop fasteners 30 can be provided on the outer surface 12A of first portion 14A. Hook and loop fasteners 30, 34 can be formed from VELCRO® fastener strips or other contact-fastenable surfaces or, alternately, can be replaced by mechanical fastening means.

It is preferred that a padded material 40, such as foam or the like, be stitched or sewn to the inner surface 12B of body 12 as indicated at 42. Loop fasteners 44 can be sewn on the padded material 40.

Figure 4:
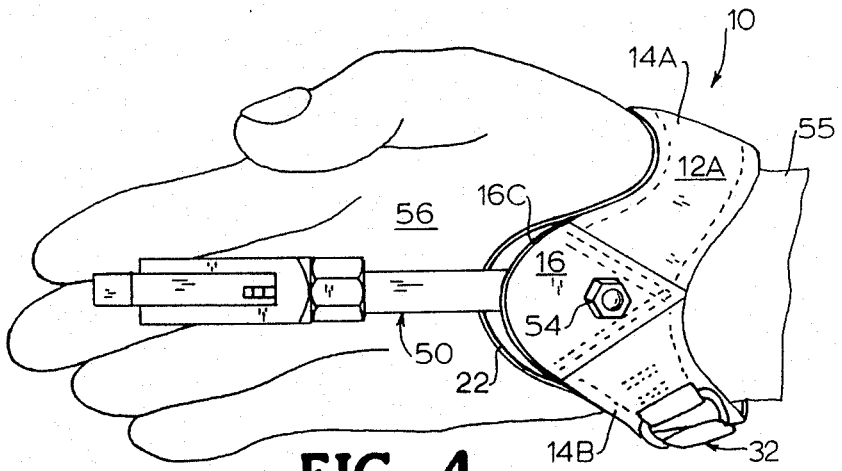
FIG. 4 is a front, side elevation view of the present wrist strap mounted on a wrist.
Figure 5:
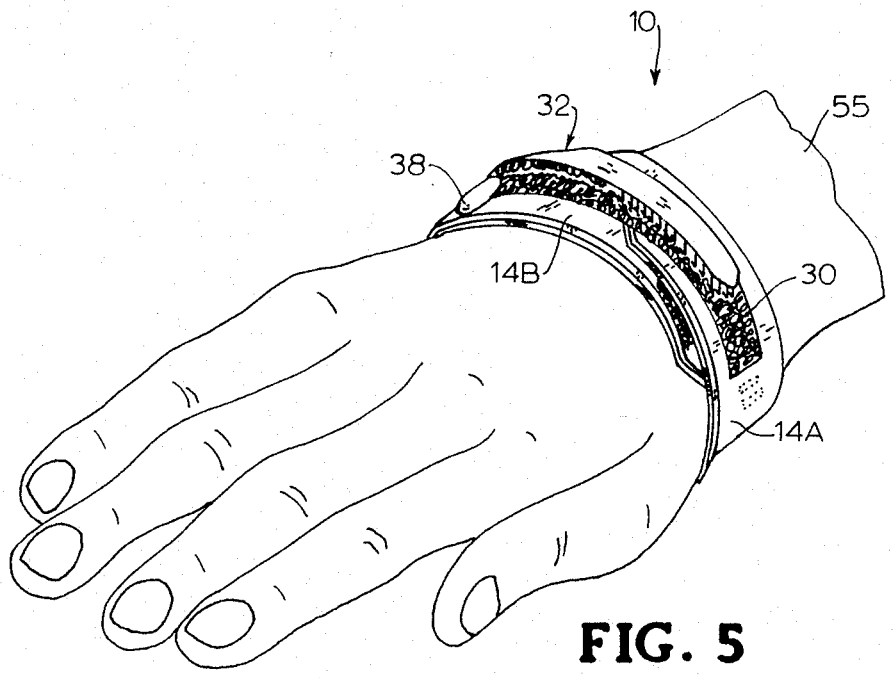
FIG. 5 is a rear, perspective view of the present wrist strap mounted on a wrist.

A typical bowstring release 50, illustrated in FIGS. 3 and 4, includes a threaded rod 52, a trigger 53 and jaws 57 for retaining a bowstring (not illustrated). The bowstring release 50 is removably secured to the wrist strap 10 by inserting rod 52 into cavity 22 and through opening 24. A nut 54 is threaded on rod 52 to secure bowstring release in cavity 22. In other bowstring releases, a tie cord or other element is inserted into cavity 22 and through opening 24 and retained by suitable means.

To mount the wrist strap 10 on a wrist 55, the inner surface 12B of the apex 18 is placed adjacent the palm 56. Second portion 14B is wrapped around and placed adjacent the wrist 55. First portion 14A is wrapped around the wrist 55 and overlapped onto second portion 14B so that loop fasteners 44 are mated with hook fasteners 36. Next, strap 32 is threaded through ring 38 and drawn in tension so that hook fasteners 34 are mated with loop fasteners 30. First portion 14A and second portion 14B are retained on wrist 55 by a first system of hook and loop fasteners 36, 44 and a second system of hook and loop fasteners 34, 30. (See FIGS. 4 & 5).

In use, a bowstring release 50 is positioned so that its longitudinal axis generally aligns with the wearer's fingers. As a bowstring is drawn, edge 16C of cavity 22 faces the bowstring. The cavity 22 permits the inner surface 12B of body 12 to remain relatively flat and adjacent the palm 56 during the drawing operation. The cavity 22 forms a guide for the bowstring release 50 which is aligned in the direction of the flight of an arrow (not illustrated). Such alignment of 22 eliminates twisting and turning of wrist strap 10, particularly at its apex 18. Elimination of twisting enhances the accuracy of the aim and improves the release.

Although the present invention has been described with reference to a preferred embodiment, persons skilled in the art will recognize that changes may be made in form and detail without departing from the spirit and scope of the invention.

What is claimed is:

1. A wrist strap for use with a bowstring release, comprising:

(a) a V-shaped body having an inner surface and an outer surface;

(b) a substantially triangular tab secured to the body outer surface at the apex of the V-shaped body, wherein the tab is secured along only two edges so that an unsecured edge forms an opening to a cavity between the tab and the body for removably receiving a bowstring release; and (c) means for removably securing the body on a wrist.

2. The wrist strap as specified in claim 1 including a padded material secured to the body inner surface.

3. The wrist strap as specified in claim 2 wherein the padded material is stitched to the body inner surface.

4. The wrist strap as specified in claim 1 wherein the means for removably securing the body on a wrist comprises contactfastenable fastening surfaces on opposite mating surfaces of the body.

5. The wrist strap as specified in claim 4 wherein the fastening surfaces comprise:

(a) hook fasteners provided on the outer surface of a second portion of the body; and (b) loop fasteners provided on the inner surface of a first portion of the body and aligned to mate with the hook fasteners when the first and second portions are wrapped about a wrist.

6. The wrist strap as specified in claim 5 wherein the fastening surfaces further comprise:

(a) loop fasteners provided on the outer surface of the body first portion;

(b) a strap having hook fasteners connected to the body first portion; and (c) a ring secured to the outer surface of the body second portion, wherein the strap is tensionally-drawn through the ring and the strap hook fasteners and the loop fasteners on the outer surface of the body first portion as mated.

7. The wrist strap as specified in claim 6 wherein the hook and loop fasteners are formed from Velcro® fastener strips.

8. The wrist strap as specified in claim 1 wherein the tab includes an opening near its central portion for removably securing the bowstring release.

9. The wrist strap as specified in claim 1 wherein the tab is stitched to the body outer surface.

10. A wrist strap for use with a bowstring release, comprising:

(a) a body, having a first portion, a second portion and a central portion having between the first and second portions, wherein each portion includes an outer surface and an inner surface;

(b) a tab secured to the central portion outer surface, wherein the tab includes at least one unsecured edge perpendicular to the longitudinal axis of the arrow that forms an opening to a cavity between the tab and the body central portion outer surface for removably receiving a bowstring release; and (c) means for removably securing the first and second body portions on a wrist so that the central portion inner surface is adjacent a wearer's palm.

11. The wrist strap specified in claim 10 wherein the means for removably securing the body on a wrist comprises contact-fastenable fastening surfaces on opposite mating surfaces of the body portions.

12. The wrist strap specified in claim 10 wherein the means for removably securing the body on a wrist comprises dual systems of contact-fastenable fastening surfaces.

13. The wrist strap specified in claim 12 wherein the dual systems of contact-fastenably fastening surfaces comprise:

(a) hook fasteners mounted on the second portion outer surface mated with loop fasteners on the first portion inner surface; and (b) a strap, secured to the first portion, having hook fasteners mated to loop fasteners on the first portion outer surface.

14. The wrist strap specified in claim 13 including a ring mounted on the second portion outer surface for receiving the strap.

15. The wrist strap specified in claim 10 including a pad secured to the inner surface of the body.

16. The wrist strap specified in claim 15 wherein the pad is stitched to the body inner surface.

17. The wrist strap specified in claim 10 wherein the body is in the shape of a V.

18. The wrist strap specified in claim 10 wherein the tab is stitched to the central portion outer surface.

* * * * *

UNITED STATES PATENT AND TRADEMARK OFFICE

CERTIFICATE OF CORRECTION

PATENT NO. : 4,831,997

DATED : May 23, 1989

INVENTOR(S) : James H. Greene

It is certified that error appears in the above-identified patent and that said Letters Patent is hereby corrected as shown below:

Column 4, line 8, change "contactfastenable" to --contact-fastenable--.

Column 4, lines 46 and 47, change:

"arrow that forms an opening to a cavity between the tab and the body central portion"

to:

--arrow that forms an opening to a cavity between the tab and the body central portion--.

Signed and Sealed this

Ninth Day of January, 1990

*Attest:*

JEFFREY M. SAMUELS

*Attesting Officer*

*Acting Commissioner of Patents and Trademarks*